US007363849B2

(12) United States Patent
Kurz et al.

(10) Patent No.: US 7,363,849 B2
(45) Date of Patent: Apr. 29, 2008

(54) AXIAL PISTON MACHINE WITH OFFSET POSITIONING ELEMENT AND CAM DISK FOR SUCH AN AXIAL PISTON MACHINE

(75) Inventors: Herbert Kurz, Ulm (DE); Walter Jauernig, Guenzburg (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 74 days.

(21) Appl. No.: 10/550,292

(22) PCT Filed: Mar. 26, 2004

(86) PCT No.: PCT/EP2004/003250

§ 371 (c)(1),
(2), (4) Date: Sep. 20, 2005

(87) PCT Pub. No.: WO2004/109107

PCT Pub. Date: Dec. 16, 2004

(65) Prior Publication Data

US 2006/0180016 A1 Aug. 17, 2006

(30) Foreign Application Priority Data

Jun. 11, 2003 (DE) ..... 103 26 059
Oct. 10, 2003 (DE) ..... 103 47 086

(51) Int. Cl.
*F01B 13/04* (2006.01)

(52) U.S. Cl. ..... 92/57

(58) Field of Classification Search ..... 92/57
See application file for complete search history.

(56) References Cited

U.S. PATENT DOCUMENTS 2,968,286 A * 1/1961 Wiggermann ..... 92/57
6,279,452 B1 * 8/2001 Moya ..... 92/57
6,283,721 B1 * 9/2001 Gollner ..... 92/12.2

FOREIGN PATENT DOCUMENTS

| | | |
|---|---|---|
| DE | 100 30 147 C1 | 6/2002 |
| DE | 101 19 236 C1 | 12/2002 |
| EP | 0 976 912 A2 | 2/2000 |
| EP | 1 008 748 A2 | 6/2002 |

* cited by examiner

*Primary Examiner*—F. Daniel Lopez
(74) *Attorney, Agent, or Firm*—Scully, Scott, Murphy & Presser, P.C.

(57) ABSTRACT

The invention relates to an axial piston machine (1) comprising a housing (2) in which a drive disk (7) and a cylinder block (12) axially disposed next to it are received so as to be rotatable relative to each other about longitudinal center axes (11, 13). These axes run obliquely at an angle (W1) relative to each other in an oblique axis plane (E). A cam disk (18) is disposed on the front of the cylinder block (12) facing away from the drive disk (17) and is supported on the housing (2) by means of a positioning device (19) with positively engaging positioning elements (19*a*, 19*b*). A guide element (21) having a guide center axis (22) running coaxially to the longitudinal center axis (13) of the cylinder block (12) is disposed on the side facing the cylinder block (12). In order to provide for a simple construction and to allow for a step-wise modification of the throughput, the positioning element (19*b*) disposed on the cam disk (18) is set off in the oblique axis plane (E) at an angle to the guide center axis (22). The cam disk (18) can be mounted in a second position, rotated relative to the guide center axis (22) by approximately 180°, in which the positioning elements (19*a*, 19*b*) are also functionally linked.

8 Claims, 4 Drawing Sheets

AXIAL PISTON MACHINE WITH OFFSET POSITIONING ELEMENT AND CAM DISK FOR SUCH AN AXIAL PISTON MACHINE

The invention relates to an axial piston machine and a cam disc for such an axial piston machine.

An axial piston machine of this type is, for example, disclosed in DE 100 30 147 A1 and namely both as an axial piston machine with constant throughput volume and with variable throughput volume.

The throughput volume is varied in this known construction by the cylinder drum and the cam disc being pivoted in the oblique axis plane containing the centre axes of the drive disc and the cylinder drum. To this end a driving connection with positioning elements positively engaging in one another can be provided between the cam disc and the housing or a control block in place of a housing wall. In this connection, the pivoting takes place in a circular arc shaped guide curved about the intersection of the centre axes and extending in the oblique axis plane and in which the cam disc is pivotally guided.

The object of the invention is to design an axial piston machine and a cam disc for such an axial piston machine, ensuring a simple construction, such that a step-wise variation of the throughput volume is possible.

The invention is based on the recognition that, instead of pivoting in a guide, the cam disc can be adjusted by an offset of the cam disc which can be achieved by rearranging the cam disc by rotating it by 180 DEG about its guide centre axis. As a result, two positions of the cam disc are produced, arranged offset to one another in the oblique axis plane and in which the angle between the centre axes of the drive disc and the cylinder drum is variable and therefore the throughput volume is variable.

In an embodiment, the positioning element arranged on the cam disc is transversely offset relative to the guide centre axis in the oblique axis plane, the cam disc being optionally able to be installed in two positions offset by 180° to one another.

In an embodiment, the positioning element arranged on the cam disc is arranged offset relative to the guide centre axis in the oblique axis plane.

The two embodiments according to the invention allow a lateral displacement of the cam disc which leads to variable volume adjustment depending on the oblique axial arrangement. In this connection, one of these two volume adjustments can optionally be carried out by the cam disc being rearranged by rotating it by 180° or the cam disc already being specifically installed during the initial installation in one of its two positions. As a result, the desired throughput volume can be considered during installation and initial installation of the axial piston machine. The size of the throughput volume variation can be determined by the size of the offset dimension, by which the positioning element arranged on the cam disc is offset relative to the guide centre axis.

The two embodiments according to the invention are suitable for variable throughput volumes which can be set. As a result it is possible, when assembling the axial piston machine, to establish whether the throughput volume is to be larger or smaller than a desired throughput volume range.

An offset of less than 10°, in particular of approximately 3°, allows the creation of large flow cross-sections for the flow channels in the cam disc and in the connecting part. Thus flow losses can be reduced and the speed stability and the efficiency of the axial piston machine can be improved.

The invention is also suitable for use in combination with an axial piston machine of which the throughput volume can be set by pivoting the cam disc by means of an adjustment device. With this combination, the embodiment according to the invention firstly allows a displacement of the adjustment range to a minimum direction of, for example, 0° or a maximum direction of, for example, 32° and secondly an increase of the adjustment range when the cam disc is positioned, such that the adjustment path is increased by the offset.

The embodiment according to the invention is thus suitable both for such axial piston machines, in which the cam disc cannot be displaced in its installed position and for such axial piston machines in which the cam disc can be displaced for the purpose of altering the throughput volume in a circular arc shaped guide curved about the intersection of the centre axes of the drive disc and the cylinder drum. In the last described embodiment, the throughput volume can be varied steplessly in the region of the guide. In this embodiment the embodiment according to the invention is preferably suitable for varying the throughput volume in the region of the maximum limit of the adjustment range.

The aforementioned advantages can also therefore be achieved when the embodiment according to the invention is combined with an axial piston machine, of which the adjustment range is smaller than the increased adjustment range which can be achieved by the offset of the cam disc. If the adjustment device of the axial piston machine is designed, for example, for an adjustment range of 0° to 26°, then by a specific installation or rearrangement of the cam disc according to the invention, the pivoting range can moreover be set from 0° to 26° in its one position and in the other position an adjustment range increased by the offset dimension can be set, which however ends before the minimum setting 0°. With an offset dimension of, for example, approximately 3°, in the latter case an adjustment range of 6° to 32° can be set.

A raised portion on the side of the cam disc facing the cylinder block is suitable as a guide element for the cylinder block and which cooperates positively with a correspondingly formed front face of the control block. In an axial piston machine with a rotatably mounted cylinder block, namely a so-called cylinder drum, a rotationally-symmetrically curved design of the guide element and of the front face of the cylinder drum cooperating positively therewith is required.

As a positioning device for positioning the cam disc, a positive engagement known per se between a recess and a pin held therein is well suited to ensure a simple and inexpensive construction.

The invention will be described hereinafter with reference to advantageous designs of an embodiment, in which.

Figure 1:
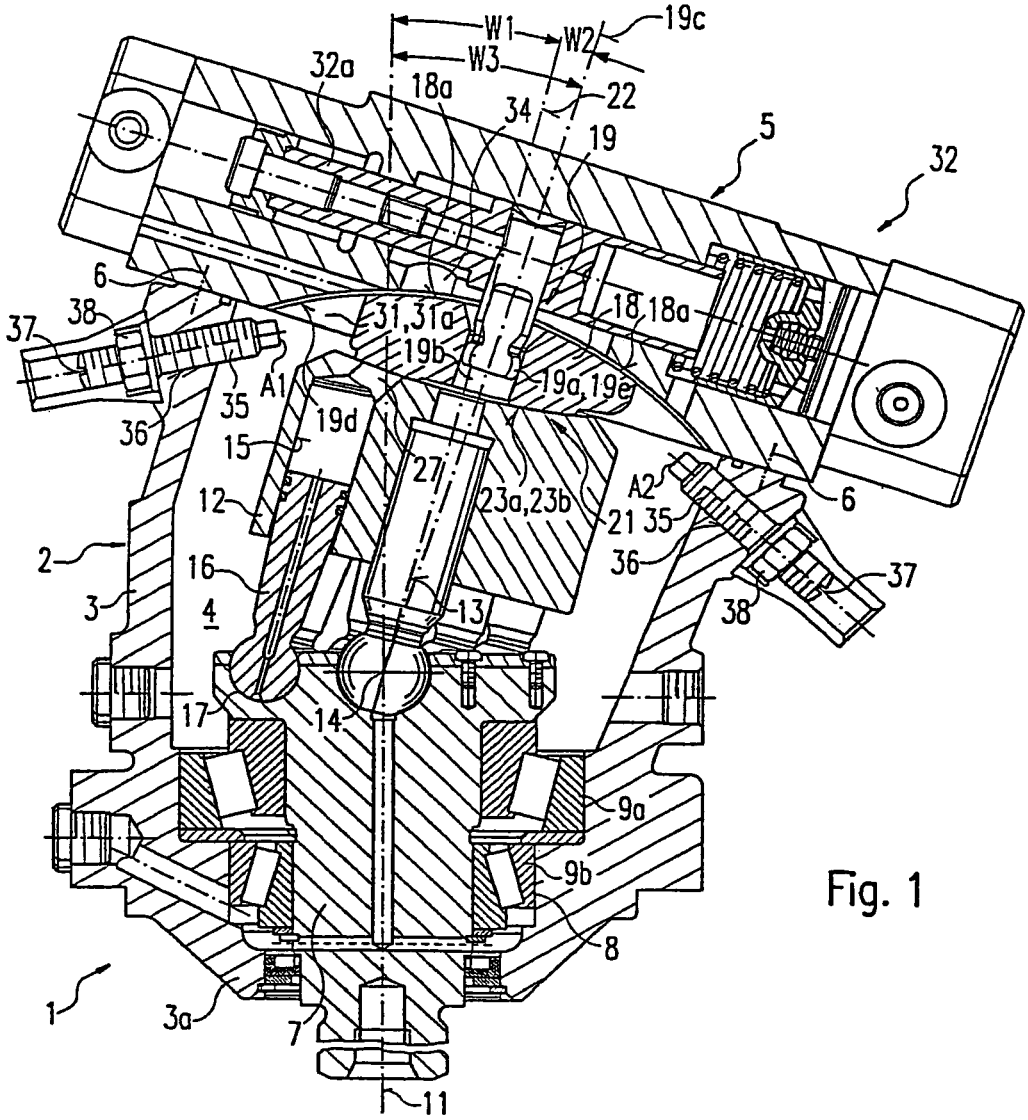
FIG. 1 is an axial piston machine according to the invention with variable throughput volume in axial section.

In the axial piston machine shown by way of example and denoted as a whole by 1, the axial piston machine is of oblique axis construction. This construction comprises a closed housing 2, with a pot-shaped housing part 3, of which the housing interior 4 can be releasably closed by a so-called connecting part 5 which is screwed by means of screws 6 shown in outline to the free edge of the housing part 3. In the housing 2 a drive disc or drive shaft 7 is rotatably mounted which passes through the one base wall 3*a* of the pot-shaped housing 3 in a through hole 8 and is rotatably mounted therein, for example by means of roller bearings 9*a*, 9*b* which are seated in the through hole 8.

In the present embodiment, in which the drive disc is rotatably mounted, the longitudinal centre axis 11 of the drive disc 7 is simultaneously its rotational axis. Axially mounted in the vicinity of the drive disc 7 is a cylinder block 12 in the housing interior 4 with a longitudinal centre axis 13 which extends obliquely relative to the longitudinal centre axis 11 of the drive disc 7 in an oblique axis plane containing the two longitudinal centre axes 11, 13, so that the longitudinal centre axes 11, 13 include an acute angle W1 which is open toward the side facing away from the drive disc 7. The intersection of the longitudinal centre axes 11, 13 is denoted by 14.

In the cylinder block 12, a plurality of piston bores 15 are distributed on its cross-section and arranged parallel, for example, relative to the centre axis 13 and which open out in the direction of the drive disc 7 and in which pistons 16 are mounted which can be displaced to and fro and of which the ends facing the drive disc 7 are supported in a universally pivotal manner on the drive disc 7. To this end, spherical segment bearings 17 are provided in the embodiment between the pistons 16 and the drive disc 7.

On the front face of the cylinder block 12 facing away from the drive disc 7 a cam disc 18 is arranged which is supported on the housing 2 by a positioning device 19 and on its side facing the cylinder block 12 comprises a guide element 21, with a guide centre axis 22 for the cylinder block 12. The guide centre axis 22 extends transversely to the cam disc 18 and in the centre region of the cam disc 18, as well as coaxially to the longitudinal centre axis 13 of the cylinder block 12. This is supported in the direction of the cam disc 18 by guide surfaces 23*a*, 23*b* bearing against one another and by the guide element 21 on the cam disc 18, transversely to the guide centre axis 22.

By means of a relative rotation between the drive disc 7 and the cylinder block 12 the pistons 16 are pushed to and fro due to the presence of the axial angle W1 and, depending on the rotational direction, the pistons 16 drawing in fluid on the one side of the longitudinal centre axis 13 and displacing it on the other side. Thus the fluid flow flows from an inlet, not shown, through control channels 25 in the cam disc 18, arranged symmetrically on the two sides coaxially to the guide centre axis 22, through channels 26 in the connecting part 5 extending toward the control channels 25 and through channels 27 in the cylinder block 12 extending from the control channels 25 toward the piston bores 15, to an outlet, not shown, also arranged on the connecting part 5.

In the embodiment the guide element 21 is formed by the guide surfaces 23*a*, 23*b*, preferably spherical sector-shaped, being curved concentrically to the guide centre axis 22 and the longitudinal centre axis 13 and namely curved in a concave manner on the front face of the cylinder block 12 and curved in a convex manner on the opposing front face of the cam disc 18, so that the guide surface 23*a* defines a raised and convex guide element 21, as is known per se.

The positioning device 19 is formed by a positioning element 19*a* on the connecting part 5 and a positioning element 19*b* cooperating therewith on the cam disc 18. The positioning elements 19*a*, 19*b* cooperate positively, such that a movement directed transversely to the guide centre axis 22 and a movement of the cam disc 18 away from the cylinder block 12 is positively locked by the positioning device 19 on the connecting part 5. The positioning elements 19*a*, 19*b* engage in one another along an engagement axis 19*c*. An embodiment of the positioning elements 19*a*, 19*b* which can be easily assembled and disassembled is then achieved, if it can be assembled and disassembled by an assembling and disassembling movement of the cam disc 18 and the connecting part 5 directed along the guide centre axis. In such an embodiment the positioning element 19*b* on the cam disc 18 is accessible to the positioning element 19*a* on the connecting part 5 from the connecting face, on which the connecting part 5 is located.

In the embodiment the positioning element 19*b* is formed on the cam disc by a recess open from, and therefore accessible from, the connecting part 5 and in which a positioning pin protruding from the control part 5 toward the cam disc 18 is held with slight motional clearance. In this connection, the positioning device 19 is constructed such that the centre axis 19*c* of the positioning device 19 oriented transversely to the cam disc 18, is laterally offset relative to the guide centre axis 22 in the oblique axis plane E containing the two centre axes 11, 13. The corresponding offset dimension a is produced by the offset angle W2. As a result, the positioning element 19*a* is also laterally offset relative to the guide centre axis 22 by the offset angle W2. The offset angle W2 is smaller than approximately 10° and is preferably approximately 3°.

The positioning device 19 further comprises a bearing face 19*d* on the connecting part 5 facing the cam disc 18. The cam disc 18 rests with one bearing face 18*a* on its front face facing the connecting part 5 on the bearing face 19*d* and is thereby supported on the side facing away from the cylinder block 12.

Figure 2:
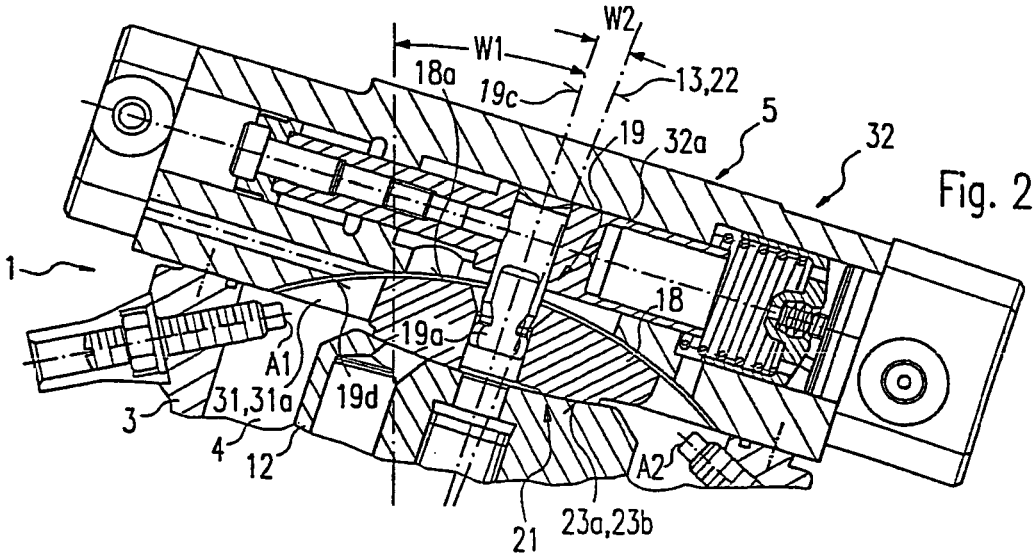
FIG. 2 is a portion of the axial piston machine in an altered position relative to its throughput volume.
Figure 3:
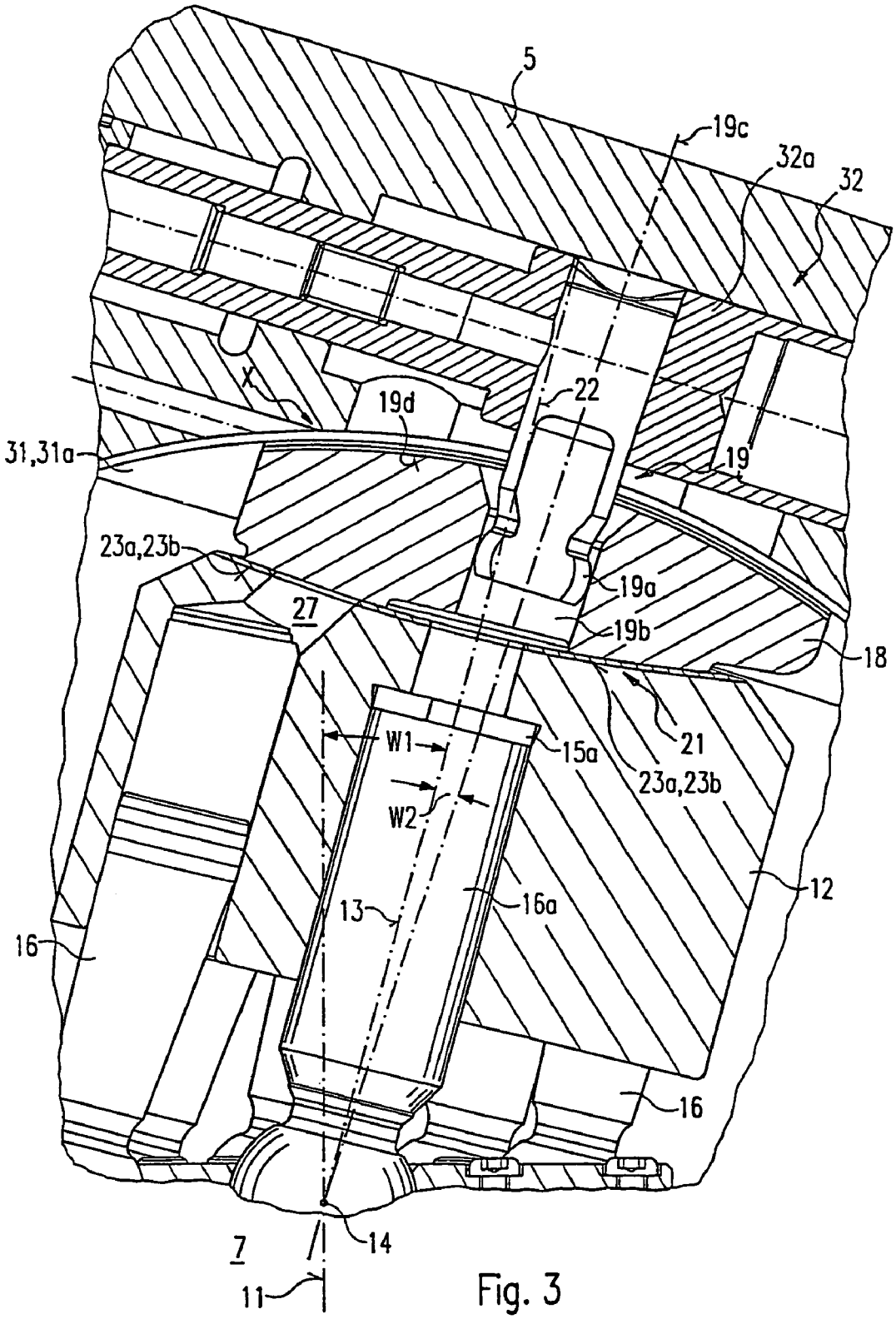
FIG. 3 is an enlarged view of a substantial region of the axial piston machine in the position according to FIG. 1.
Figure 4:
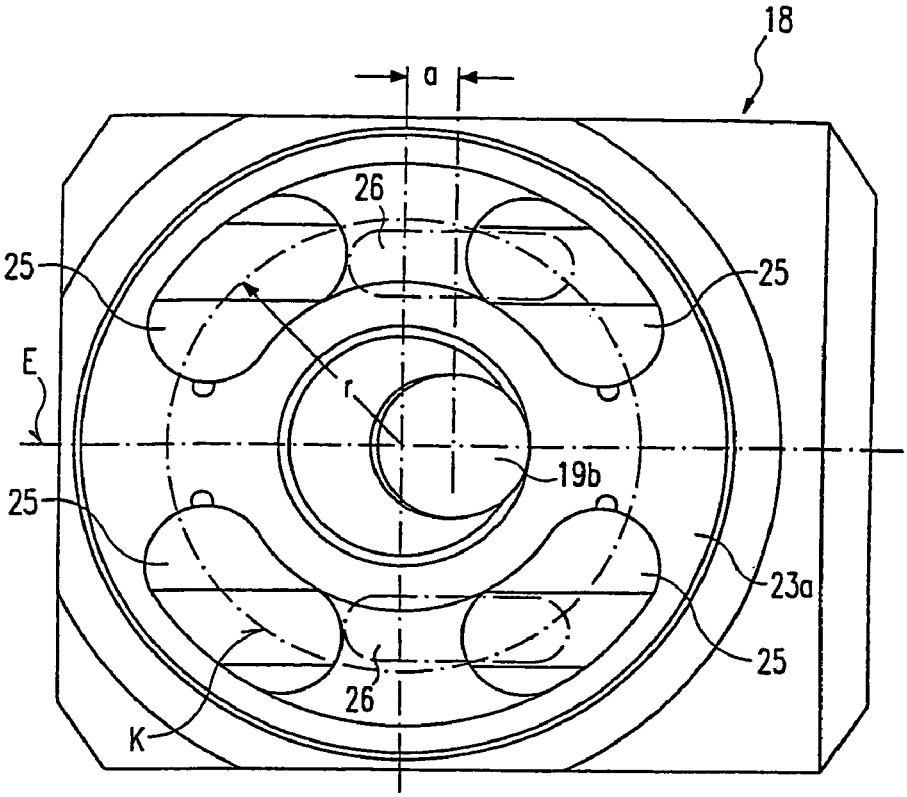
FIG. 4 is a front view of a cam disc of the axial piston machine.
Figure 5:
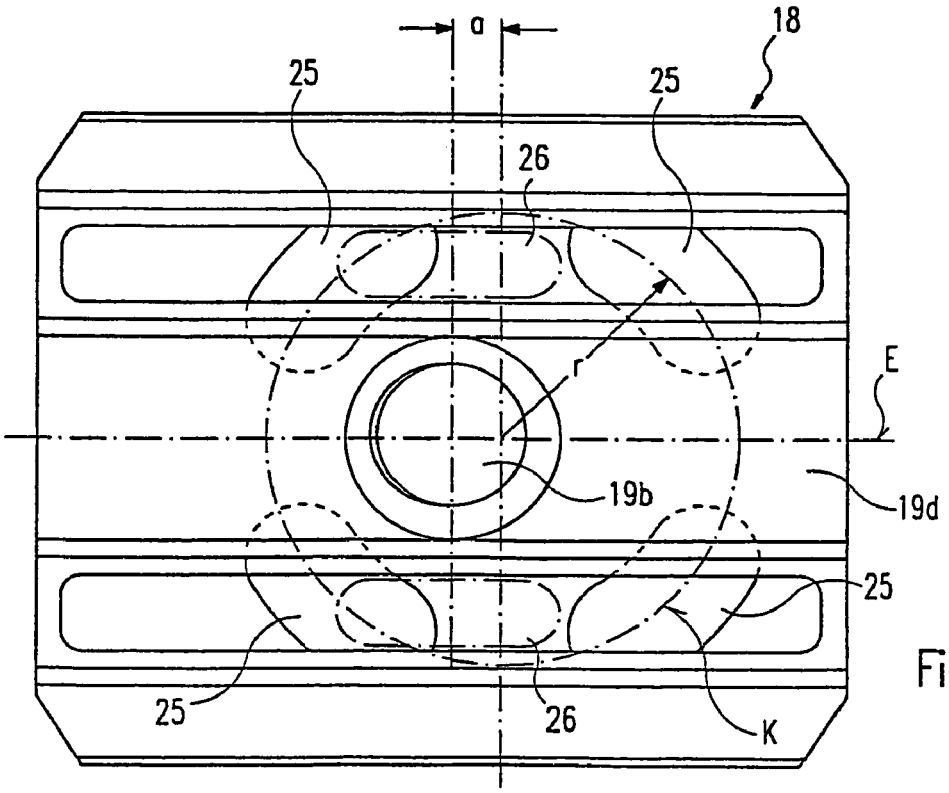
FIG. 5 is a rear view of the cam disc.

The positioning device 19 is moreover constructed such that the cam disc 18 can be installed into an offset position shown in FIG. 2 from the offset position shown in FIGS. 1 and 3 and in which it is rotated by 180° about the guide centre axis 22, and vice versa. Rearranging the cam disc 18 into the positions shown in FIGS. 1 and 2 leads to a lateral offset of the cam disc 18 and the cylinder block 12 guided thereon, this offset being double the size of the offset a produced by the offset angle W2.

The axial piston machine 1 disclosed thus far can therefore be assembled by installing the cam disc 18 in a specific assembly position or by rearranging the cam disc 18 into positions rotated by 180°. In these positions of the cam disc 18 the axial piston machine 1 can be set to two throughput volumes of variable sizes and can be adjusted in one step.

In the embodiment shown, the cam disc 18 can be laterally pivoted to and fro and fixed in addition to the aforementioned positions in a pivoting guide 31 extending parallel to the oblique axis plane E, the pivoting guide 31 being curved about the intersection 14 of the longitudinal centre axes 11, 13. Moreover, an adjustment device 32 is provided, by means of which the cam disc 18 in the rotating guide 31 can be steplessly adjusted to and fro in the oblique axis plane E between a minimum position, for example with a pivoting angle of 0° and a maximum position, for example with a pivoting angle of 26° and fixed in the respective pivoting position.

In the embodiment the pivoting guide 31 is formed by a guide groove 31*a* in the wall of the connecting part 5 facing the housing interior 4, the base of the guide groove 31*a* being formed by the bearing surface 19*d* and being curved in a concave manner about the intersection 14 and forming a curved guide and bearing surface 19*d*, on which the cam disc 18 slideably rests with its correspondingly convex curved bearing surface 18*a*. The adjustment device 32 is moreover incorporated in the connecting part 5 and, for example, formed by an adjusting slider 32*a* which can be specifically displaced hydraulically transversely to the guide centre axis 22 and to and fro in a slide guide in the oblique axis plane E and can be fixed in the respective setting. The connecting part 5 is arranged obliquely relative to the centre axis 11 in the oblique axis plane and with the centre axis 11 includes an acute angle W3 which corresponds to half the angle of the pivoting angle region and in the embodiment is approximately 16°. In this connection, W3=16° for the two exemplary adjustment ranges 0-26° and 6-32°.

The positioning element 19*a* arranged on the connecting part 5 is fastened in the embodiment to the adjusting slider 32*a* and can be displaced to and fro therewith in a corresponding free space 34 and slot, the cam disc 18 being driven by means of the cooperation of the positioning elements 19*a*, 19*b*. In order to ensure positioning in the offset oriented transversely to the guide centre axis 22 in the oblique axis plane E, in spite of the variable moving directions between the positioning elements 19*a*, 19*b* (straight, curved), the pin-shaped positioning element 19*a* plunges with a circular rounded positioning head 19*e* into the recess 19*f* in the cam disc 18 forming the counter positioning part.

With such a steplessly variable axial piston machine 1, the embodiment according to the invention allows either a reduction or increase in the throughput volume of the axial piston machine or a specific setting of the axial piston machine from the outset by a corresponding rearrangement or initial assembly.

A particular advantage of the embodiment according to the invention can be seen by the embodiment according to the invention being restricted to the design of the cam disc and therefore the embodiment according to the invention is suitable for resetting the piston machine, without its other parts having to be altered. Thus, for example by a corresponding offset of the cam disc, the adjustment range of the adjustment device can be increased by the offset dimension, without it requiring itself a corresponding enlargement of the adjustment device. This becomes clear when one considers that in an adjustment device with an adjustment range of, for example, approximately 0 to 26° the embodiment according to the invention retains this adjustment range in the one position of the cam disc and in the other position results in an adjustment range which is increased by the offset dimension of the cam disc, but which ends at the offset dimension before the zero point of the adjustment device. Even when the axial piston machine is installed from the outset with only one of the two pivoting angle regions, the two pivoting angle regions can be produced with a high similarity of parts.

The end positions of the pivoting regions can be defined by stops A1, A2, which are adjustable and can be incorporated in the connecting part 5 as end stops for the adjusting slider 32*a*. In the embodiment, a minimum stop A1 and a maximum stop A2 respectively formed by an adjustment screw 35 which passes through the peripheral wall of the housing 2 in a threaded hole 36, approximately in the oblique axis plane E, protrudes into the housing interior 4 and can be rotated externally by a rotary tool which can be applied to a rotatable engagement member, for example a slot 37 and can be fixed, for example by means of a lock nut 38.

In the aforementioned embodiments the cam disc 18 is non-displaceably positioned in each pivoting position relative to the cylinder block 12 in the pivoting plane E. Thus between the cam disc 18 and the cylinder block 12 a positioning device 41 acts which positions these two parts non-displaceably on one another in the pivoting plane E. This positioning is carried out by the convex form of the cam disc 18 in the pivoting plane E and the concave form of the cylinder block 12. Therefore, the cam disc 18 is able to drive the cylinder block 12 when it is displaced in the pivoting plane E, the positioning device 41 acting as a drive device. The guide element 21 thus allows the rotation of the cylinder block 12 during the positioning.

This positioning device 41 is prone to an effective clamping action between the cam disc 18 and the cylinder block 12 due to the relatively slight arcuate form of the guide surfaces 23*a*, 23*b*.

It is therefore advantageous to stabilise the positioning device acting between the cam disc 18 and the cylinder block 12, such that the aforementioned clamping action and greater wear and tear and increase in temperature resulting therefrom can be reduced or prevented.

Figure 6:
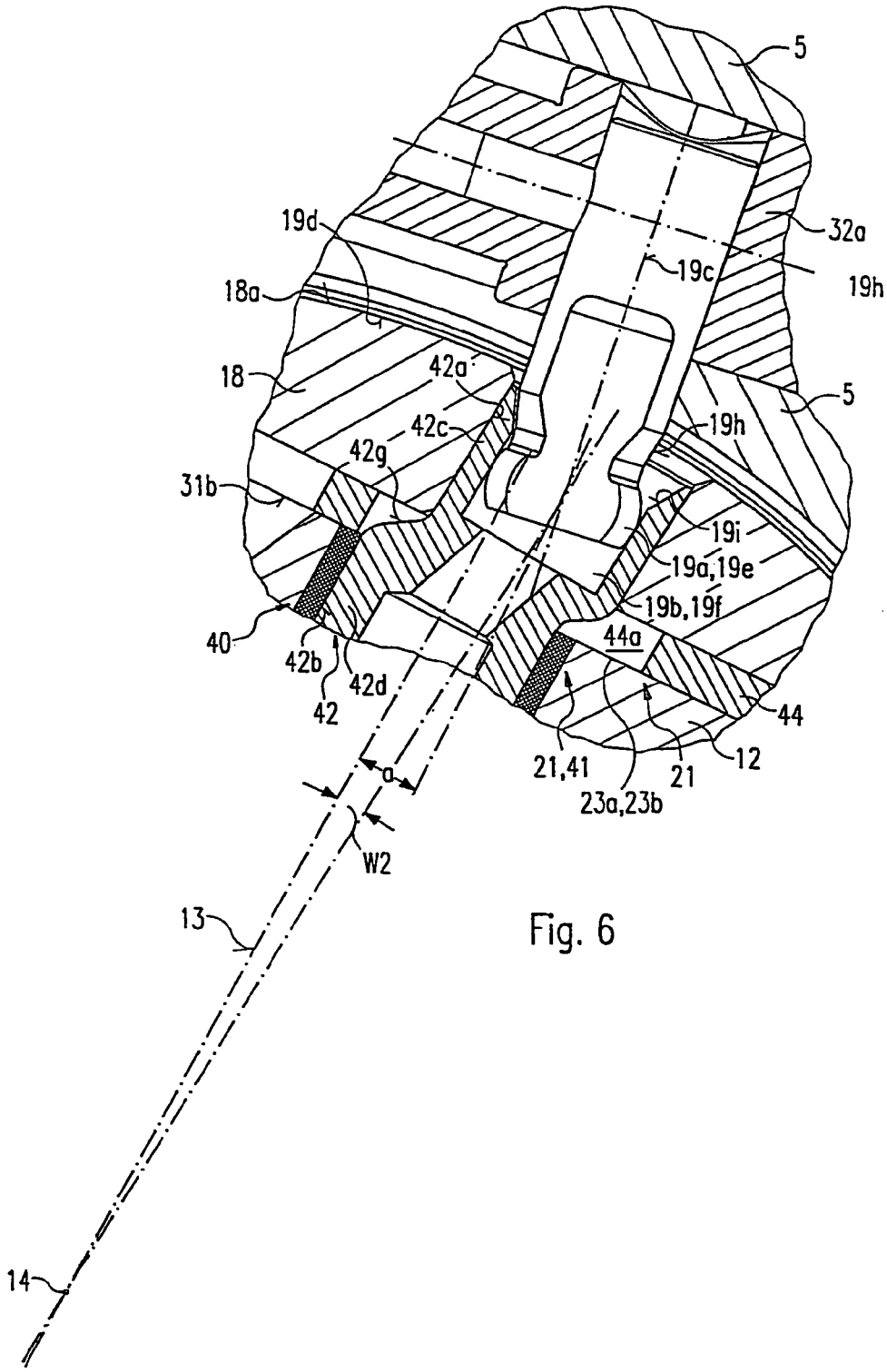
FIG. 6 is the region identified by X in FIG. 3 of the axial piston machine in a modified embodiment.

In the embodiment according to FIG. 6 the positioning device 41 is formed by an additional pin connection acting between the cam disc 18 and the cylinder block 12, with a positioning pin 42 which is held in an appropriate manner respectively in positioning recesses 42*a*, 42*b* in the cam disc 18 and in the cylinder block 12 and in addition passes through the gap 31*b* therebetween. Moreover the pin portions 42*c*, 42*d* of the positioning pin 42 held in the positioning recesses 42*a*, 42*b* are offset to one another and cranked by the offset dimension a and the angle W2 and one or both of these pin connections can be installed in the positions of the cam disc 18 rotated by 180°. The positioning recesses 42*a*, 42*b* and the pin portions 42*c*, 42*d* preferably comprise a round cross-section. Due to the offset a the positioning pin 42 is, relative to the cam disc 18, unrotatably mounted in the cam disc 18. In the transitional region 42*g* between the pin portions 42*a*, 42*b* the positioning pin 42 can comprise side portions extending obliquely, which preferably are convex and concave and merge with the pin portions 42*c*, 42*d*, as the drawing shows. The positioning recess 42*b* forms a rotary bearing 40 for the cylinder block 12. This can be a roller- or friction bearing which can comprise a sliding bushing 12*a* fastened to one of the rotary bearing parts.

In the embodiment according to FIG. 6 the positioning recess 19*b* is arranged in the pin portion 42*c*, it being adapted relative to its cross-sectional form and size to the cross-sectional size and form of the positioning element 19*a* and able to be formed by a blind hole open on the front face. The positioning recess 19*b* is preferably formed by a longitudinally extending channel and open toward a guide hole 15*a* receiving a centre guide pin 16*a*. As a result, the lubrication of the positioning elements 19*a*, 19*b* is improved.

Furthermore, the positioning elements 19*a*, 19*b* can be constructed as in the embodiment according to FIG. 3, namely with a waist 19*h* on the positioning head 19*e* and a recess widening 19*i* on the perforated edge facing the housing and connecting part 5, in order to increase the available pivoting region.

A sliding layer 44 arranged between the cam disc 18 and the cylinder block 12 made from antifriction and/or hard-wearing material can be formed by a disc which can be fastened to the cam disc 18, for example by soldering, welding or bonding. A hole 44*a* penetrated by the positioning pin 42 in the disc is large enough for the transitional region 42*g* therein to have a free space in the two offset positions.

In the embodiment according to FIG. 6 the guide surfaces 23*a*, 23*b*, contrary to the aforementioned embodiment, are planar surfaces; they can however also be of spherical sector-shaped concave and convex construction, as is the case in the aforementioned embodiment.

The positioning recess 42*b* and the pin portion 42*d* are preferably arranged coaxially to the longitudinal centre axis of the cylinder block 12. The positioning recess 42*a* and the positioning pin 42*c*, as well as the positioning recess 19*b*, can be offset parallel relative to the longitudinal centre axis 13 and the offset a. In the embodiment the positioning recess 42*a*, the pin portion 42*c* located therein and the positioning recess 19*b* are arranged together, rotated by the angle W2 relative to the longitudinal centre axis 19.

The rearrangement of the cam disc 18 can take place when the housing cover and connecting part 5 are removed, by the cam disc 18 being removed from the pin portion 42*c*, rotated by approximately 180° about the centre axis 13 and then replaced, or by the cam disc 18 being lifted with the positioning pin 42 out of the positioning recess 42*b*, rotated by 180° approximately about the centre axis and again inserted into the positioning recess 42*b*. As far as possible, the rearrangement can also take place by the positioning pin 42 being rotated by 180 DEG in the positioning recess 42*b*.

The invention claimed is:

1. Axial piston machine with a housing, in which a drive disc and a cylinder block axially arranged in its vicinity are rotatably mounted relative to one another about longitudinal center axes, which extend obliquely to one another by an angle (W1) in an oblique axis plane (E), a plurality of piston bores being arranged in the cylinder block and in which pistons are displaceably guided axially to and fro, of which the piston ends facing the drive disc are supported in a universally pivotal manner on the drive disc, on the front face of the cylinder block facing away from the drive disc a cam disc being arranged which is supported on the housing by a first positioning device with positively cooperating positioning elements and on its side facing the cylinder block comprising a guide element with a guide center axis extending coaxially to the longitudinal center axis of the cylinder block, wherein at least one of said positioning elements is arranged on the cam disc offset transversely to the guide center axis in the oblique axis plane (E) and the cam disc is able to be installed in a further position rotated by approximately 180° about the guide center axis, in which the positioning elements also cooperate, said cylinder block being positioned positively against relative displacement in the oblique axis plane (E) by a second positioning device, said second positioning device being formed by a positioning pin which is seated with a pin portion in a positioning recess in the cam disc and is seated in a positioning recess of the cylinder block with a positioning pin offset in the oblique axis plane (E) by the offset (a).

2. Axial piston machine according claim 1 wherein the positioning element is offset relative to the guide center axis by an offset angle (W2) which is smaller than approximately 10°.

3. Axial piston machine according to claim 2, wherein the offset angle (W2) is approximately 3°.

4. Axial piston machine according to claim 1, wherein the pin portion seated in the cylinder block is rotatably mounted in the cylinder block by a rotary bearing.

5. Axial piston machine according to claim 1, wherein the pin portion seated in the cam disc forms a positioning element for the first positioning device.

6. Axial piston machine according claim 5, wherein the positioning element is formed by a positioning recess open on the front face.

7. Axial piston machine according to claim 1, wherein between the cam disc and the cylinder block a disc with a hole is arranged for the positioning pin which preferably is large enough so that in the offset position of the cam disc a transitional region of the positioning pin preferably extending obliquely has a free space in the hole.

8. Axial piston machine according to claim 1, wherein the positioning pin comprises an elongate through hole which preferably opens out into the positioning recess.

* * * * *